US006921882B2

(12) United States Patent
Gadow et al.

(10) Patent No.: US 6,921,882 B2
(45) Date of Patent: Jul. 26, 2005

(54) CERAMIC COOKTOP

(75) Inventors: Rainer Gadow, Aschau am Inn (DE); Andreas Killinger, Filderstadt-Bernhausen (DE); Christian Friedrich, Munich (DE); Chuanfei Li, Stuttgart (DE); Karsten Wermbter, Budenheim (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 10/647,811

(22) Filed: Aug. 25, 2003

(65) Prior Publication Data

US 2004/0112886 A1 Jun. 17, 2004

Related U.S. Application Data

(63) Continuation of application No. PCT/EP02/01743, filed on Feb. 19, 2002.

(30) Foreign Application Priority Data

Mar. 6, 2001 (DE) ..... 101 12 234

(51) Int. Cl.[7] ..... H05B 3/68
(52) U.S. Cl. ..... 219/465.1; 219/543; 428/404
(58) Field of Search ..... 219/465.1, 466.1, 219/543, 544, 546, 547, 548; 501/126, 127, 128, 132, 87, 89, 93, 94, 102, 103, 108, 153; 428/404, 406, 415, 416, 417, 418

(56) References Cited

U.S. PATENT DOCUMENTS

| | | | | |
|---|---|---|---|---|
| 3,110,571 A | * | 11/1963 | Alexander | 428/564 |
| 3,978,315 A | * | 8/1976 | Martin et al. | 219/543 |
| 4,764,341 A | * | 8/1988 | Flaitz et al. | 419/9 |
| 4,952,903 A | | 8/1990 | Shibata et al. | |
| 5,532,458 A | | 7/1996 | Kratel et al. | |
| 6,037,572 A | | 3/2000 | Coates et al. | |
| 6,448,538 B1 | * | 9/2002 | Miyata | 219/444.1 |
| 6,762,396 B2 | * | 7/2004 | Abbott et al. | 219/543 |

FOREIGN PATENT DOCUMENTS

| | | |
|---|---|---|
| DE | 31 05 065 A1 | 8/1982 |
| EP | 0 560 708 A1 | 9/1993 |
| EP | 0 866 642 A2 | 9/1998 |
| EP | 0 951 202 A2 | 10/1999 |

* cited by examiner

*Primary Examiner*—Sang Y. Paik
(74) *Attorney, Agent, or Firm*—Harness, Dickey & Pierce, P.L.C.

(57) ABSTRACT

The invention relates to a ceramic cooktop comprising a cooking plate (12) made of glass ceramic or glass. The ceramic cooktop also comprises an electrical heat conductor layer (22) and an insulating layer (14) that is located between the cooking plate (12) and the heat conductor layer (22). The insulating layer (14) consists of a plurality of individual layers (16, 18, 20) that each have a porosity that decreases toward the heat conductor layer (22).

32 Claims, 1 Drawing Sheet

CERAMIC COOKTOP

RELATED APPLICATIONS

This is a continuation application of copending International patent application PCT/EP02/01743 filed on Feb. 19, 2002 and designating the United States which was not published in English under PCT Article 21(2), and claiming priority of German patent application DE 101 12 234.9 filed on Mar. 6, 2001. Additional copending applications are PCT/EPO2/01751 and PCT/EPO2/01742.

BACKGROUND OF THE INVENTION

The invention relates to a ceramic cooktop comprising a cooking plate of glass ceramic or glass, an electric heat conductor layer and an insulating layer between the cooking plate and the heat conductor layer. The invention further relates to a method of producing such a ceramic cooktop.

Such a ceramic cooktop is for instance known from DE 31 05 065 C2 or from U.S. Pat. No. 6,037,572.

The known ceramic cooktop comprises a cooking plate of a glass ceramic, at the lower side of which a grounded metal layer is sprayed, onto which an insulating layer of aluminum oxide is sprayed. At the lower side of the ceramic insulating layer a heat conductor is applied by a printing technique.

Such a ceramic cooktop can provide a more energy saving heating than with previously known ceramic cooktops, wherein heating is substantially performed by means of irradiation energy. Herein initial cooking power is considerably enhanced.

The insulating layer between the heat conductor layer and the cooking plate is necessary, since a glass ceramic, such as Ceran®, comprises an NTC characteristic, i.e. with rising temperature also the electric conductivity raises considerably.

Therefore, the electric insulating layer must have a breakdown resistance of about 3,750 Volts at operating temperatures, to guarantee the necessary safety requirement according to VDE.

To this end it is necessary to produce the ceramic insulating layer with a considerable layer thickness, such as for instance 200–500 $\mu$m, when utilizing $Al_2O_3$ as insulating layer.

However, it has been found that the ceramic material tends to fracture formation at such a high layer thickness and, in addition, the thermal stresses that result from the differences between the coefficients of thermal expansion between glass ceramic ($\pm 0.15\times10^{-6}$ $K^{-1}$) and ceramic ($\approx 8.0\times10^{-6}$ $K^{-1}$ for $Al_2O_3$) considerable thermal stresses result during operation, so that the ceramic insulating layer tends to chip off.

SUMMARY OF THE INVENTION

Thus it is a first object of the invention to disclose a ceramic cooktop having an improved operating, safety.

It is a second object of the invention to disclose a ceramic cooktop having a good long term stability in rough daily operation. In particular, the cooktop shall have a high stability during long term operation while ensuring the necessary electric breakdown resistance of the insulating layer at the same time.

It is a third object of the invention to disclose a ceramic cooktop that is easy to produce in a cost-effective way.

It is a forth object of the invention to disclose a method of producing such a ceramic cooktop.

These and other objects are solved according to the invention by designing the insulating layer with a plurality of layers that have porosities that decrease toward the heat conductor layer.

The object of the invention is solved completely in this way. Namely, it has been found that a gradual matching of coefficient of thermal expansion to the coefficient of thermal expansion of glass ceramic can be reached by means of the special utilization of such gradient layers. A higher porosity leads to a decrease of the elasticity module and, thereby, to an improved tolerance against thermal stresses. Thus by dividing the insulating layer into at least two individual layers, the first one of which having a higher porosity is in contact with the cooking plate, and the second one having a lower porosity faces the heat conductor layer, thus a better tolerance against stresses can be reached. In particular, the risk of fracture can be avoided even at a larger total thickness of the insulating layer. Simultaneously a good stability of the total layer composite also with respect to high temperature cycling during operation of such a ceramic cooktop is ensured.

Preferably, the individual layers of the insulating layer are prepared by thermal spraying.

Herein the different porosities of the individual layers can be generated by different powder qualities or by utilizing different burners, preferably by means of atmospheric plasma spraying (APS), or by varying the process parameters during the coating process.

In addition, an electrical conductive intermediate layer, which is preferably grounded, may be provided between the insulating layer and the cooking plate.

According to a preferred development of the invention this electrical conductive intermediate layer consists of a cermet or of an electrically conductive ceramic. While by means of a cermet a good electrical conductivity is ensured simultaneously with a relatively small coefficient of thermal expansion, the utilization of an electrically conductive ceramic, such as e.g. results from $TiO_2$ by means of oxygen loss during thermal spraying, offers the particular advantage of a good chemical compatibility and adherence to the surface of the cooking plate together with an even smaller coefficient of thermal expansion than encountered with a cermet.

Also the electrically conductive intermediate layer is, preferably, prepared by thermal spraying.

By applying such an electrically conductive grounded intermediate layer, the ceramic insulating layer may have a smaller breakdown resistance, wherein about 1,500 V are sufficient for a cooking operation. In case of failure when the heat conductor electrically breaks down to the cooking plate, due to the grounding of the cooking plate a safety device, basically known in the art, is triggered.

According to an advantageous development of the invention the layers occupy an area diminishing toward the heat conductor layer.

Herein, the layers preferably are centered with respect to each other, in particular, are arranged concentrically. By a gradual steady transition in the rim area to the respective adjacent layer stresses in the rim area are avoided.

Thus by such a design it is avoided that the rim layers chip off from the adjacent layers under the influence of thermal stresses.

Without such a design there is an increased risk of chipping off, in particular in the rim area.

It has been found to be particularly advantageous to design the layers as circular shaped layers, since thus the thermally induced stresses are smallest during operation. However, in addition, depending on the particular application, also differently shaped layers, e.g. square shaped layers or oval layers may be utilized.

If the cooktop comprises several cooking areas, such as four cooking areas, then preferably the insulating layer and the respective other layers are only provided in the region of the respective cooking area, to keep the total stresses as low as possible.

Preferably, the individual layers of the insulating layer consist of aluminum oxide which offers a particularly good adhesion and a particularly good breakdown resistance. Apart from that also layers of mullite, of cordierite, of aluminum oxide with additions of titanium oxide, of zirconium oxide or mixtures of zirconium oxide and magnesium oxide are conceivable. Mullite and cordierite offer the advantage of a small coefficient of thermal expansion, however do not have such a good adhesion to a glass ceramic surface such as aluminum oxide. In addition, it is not possible to generate layers of mullite or cordierite directly by thermal spraying on a glass ceramic surface, since the latter would be damaged thereby.

Preferably, to this end initially a bonding layer, which may for instance consist of aluminum oxide, of titanium oxide or mixtures thereof, would have to be sprayed onto the surface of the glass ceramic, before the insulating layer of mullite or of cordierite can be applied by spraying.

According to a further development of the invention the cooking plate comprises an annular groove at its side facing the heat conductor layer, the groove extending close to the rim region of the layer sprayed onto the cooking plate.

This measure in addition serves to reduce stresses in the rim region.

It will be understood that the afore mentioned features of the invention and to be described hereinafter are not applicable only in their given combinations but also in different combinations or individually without going beyond the scope of the invention.

BRIEF DESCRIPTION OF THE DRAWINGS

Further features and advantages of the invention can be taken from the following description of preferred embodiments with reference to the drawings. In the drawings.

DETAILED DESCRIPTION OF THE PREFERRED EMBODIMENTS

Figure 1:
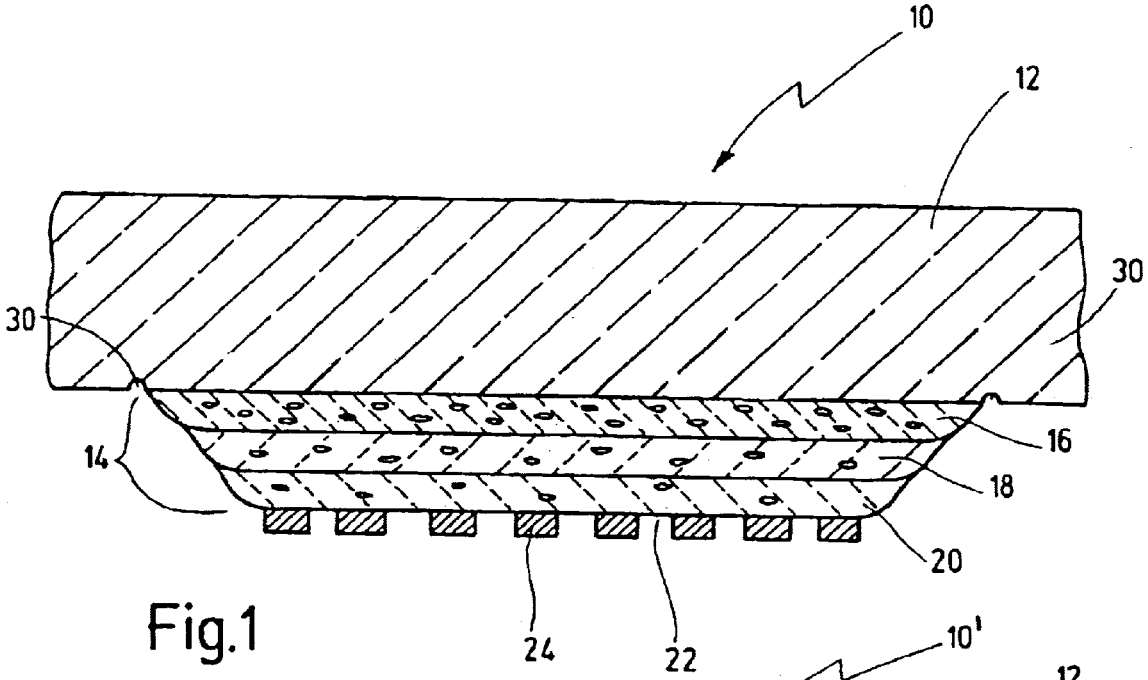
FIG. 1 shows a cross sectional view of a first embodiment of a ceramic cooktop according to the invention.

In FIG. 1 a ceramic cooktop according to the invention is designated in total with numeral 10.

It will be understood that the representation is merely of exemplary nature and that, in particular, the dimensional relations are not drawn to scale.

The ceramic cooktop 10 comprises a cooking plate 12 of a glass ceramic, such as of Ceran® of Schott, which is designed flat and serves to support cooking utensils.

The lower side of the cooking plate 12, at the areas at which a heating shall be possible, is provided with an insulating layer designated in total with numeral 14. Onto the lower surface of the insulating layer a heat conductor layer 22 is applied.

It will be understood that such a ceramic cooktop 10 may comprise a plurality of cooking areas, such as four cooking areas for household purposes. However, in FIGS. 1 and 2 only a single cooking area is shown.

The insulating layer according to FIG. 1 consists of three partial layers 16, 18, 20 which each have been applied to the cooking plate 12 or the respective layer lying thereunder, respectively, by thermal spraying.

Preferably, the individual layers 16, 18, 20 are configured circular and occupy areas diminishing toward the heat conductor layer 22. Herein the individual layers 16, 18, 20 are arranged concentrically to each other.

This measure serves to avoid that layers in the rim region chip off.

The individual insulating layers 16, 18, 20 may, e.g. consist of aluminum oxide and may each have a porosity that diminishes from the cooking plate 12 into the direction of the heat conductor layer 22.

Thus for instance the first partial layer might be applied to the surface of the cooking plate by thermal spraying and may have a porosity in the range of 15 to 20 volume percent, while the subsequent partial layer 18 may have a porosity of about 5 to 10 volume percent, and the last partial layer 20 might have a porosity as small as possible, such as 1% or even lower.

All the layers 16, 18, 20 are applied by thermal spraying (preferably by atmospheric plasma spraying).

To ensure a sufficiently high breakdown resistance, i.e. at least 3,750 V at operating temperature, the total thickness of the insulating layer 14 is up to about 500 $\mu$m when utilizing aluminum oxide.

Before thermal spraying the cooking plate 12 is not pretreated by sandblasting as common in the prior art, since this would lead to a damage of the glass ceramic surface, by contrast, it is only cleaned, e.g., degreased using acetone.

The precise delimitation of the individual layers 16, 18, 20 from the respective surface lying there under can each be ensured by a masking process.

On the lower side of the lowest partial layer 20 of the insulating layer 14 a heat conductor layer 22 is produced. This heat conductor layer 22 comprises a meander-like wound heat conductor 24 which may, e.g., be produced by a screen printing operation generally known in the art.

Alternatively, for producing the heat conductor 24 also a thermal spraying process in combination with a masking operation is suitable, this having advantages over the production by a known screen printing operation, since in screen printing the metal conductors have a glassy fraction of usually more than 5%, to lower the flow temperatures during layer firing. However, this glassy fraction reduces the metal fraction of the partial segments of the respective conductor track. The conductor track having a locally increased glass fraction has in this region a higher resistance which may possibly lead to an overheating and to a material breakdown during current flow.

These problems are avoided by a thermally sprayed heat conductor 22.

Also laser spraying is particularly suited to produce conductor tracks.

Preferably, the individual insulating layers 16, 18, 20 consist of aluminum oxide, whereby a particularly good adhesion to the surface of the cooking plate 12 can be reached. At the same time aluminum oxide offers a good breakdown resistance. By the gradient design with porosities decreasing toward the heat conductor layer 22 problems caused by thermal stresses are considerably avoided which result from differences between the coefficients of thermal expansion (about $8.0\times10^{-6}$ $K^{-1}$ for $Al_2O_3$ and about $\pm0.15\times10^{-6}$ $K^{-1}$ for Ceran®).

Also cordierite ($2MgO.2Al_2O_3.5SiO_2$) are mullite ($3Al_2O_3.2SiO_2$) may be utilized advantageously as ceramic insulation material, since this offers a considerably lower coefficient of thermal expansion $\alpha$ of about 2.2 to $2.3\times10^{-6}$ $K^{-1}$ for cordierite and of 4.3 to $5.0\times10^{-6}$ $K^{-1}$ for mullite.

However, it is not possible to apply a mullite layer or a cordierite layer directly onto a glass ceramic by thermal spraying, since this would lead to fracture formation and to a damage of the surface of the glass ceramic.

In this case initially a thin bonding layer on the order of about 10 to 150 $\mu$m, preferably of about 50 to 100 $\mu$m, would have to be sprayed onto the surface of the glass ceramic, before the subsequent insulating layers are applied.

E.g. aluminum oxide, titanium oxide or mixtures thereof are suited as bonding layers.

In addition in FIG. 1 an annular recess 30 or groove can be seen which is located at the lower side of the cooking plate 12 and which encloses the rim of the insulating layer 16 in an annular way. This recess serves to reduce stresses in this region.

Figure 2:
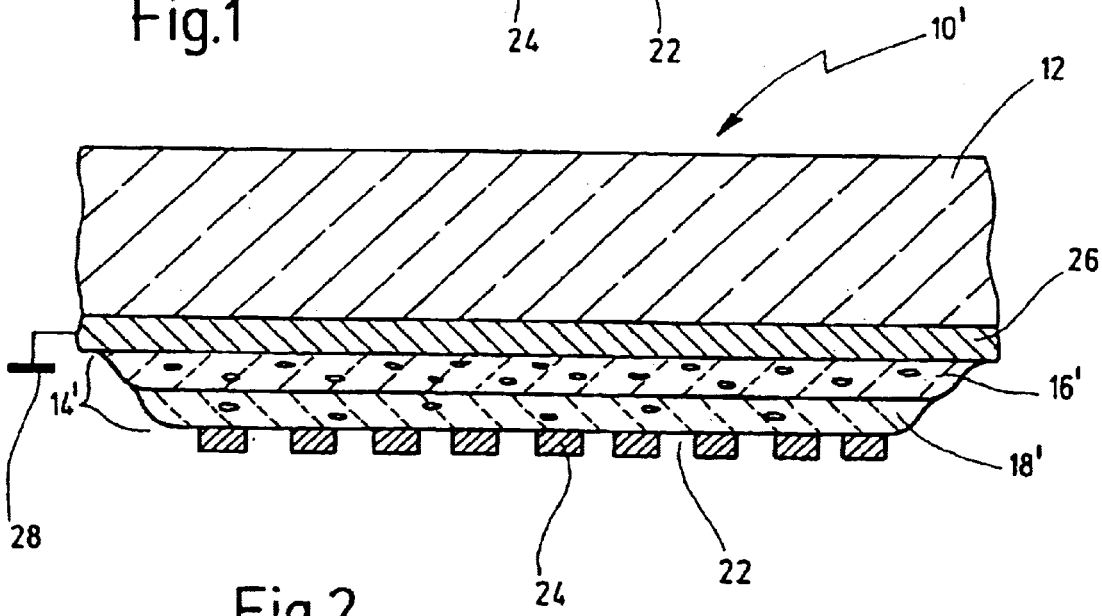
FIG. 2 shows a cross sectional view of a ceramic cooktop according to a second embodiment of the invention.

In FIG. 2 a modification of the ceramic cooktop is designated in total with numeral 10'.

This embodiment differs from the embodiment described before by the fact that the insulating layer 14' consists only of two partial layers 16', 18', and in that between the insulating layer 14' and the cooking plate 12 an intermediate layer 26 of an electrically conductive material was produced. This intermediate layer 26 is grounded, as indicated by numeral 28.

In case of failure during breakdown of the heat conductor 24 to the cooking plate 12 a safety device of the cooking plate 12 (not shown) generally known in the art, is triggered, due to the grounding.

Due to this measure the insulating layer 14' can have a smaller overall thickness, since the breakdown resistance now must only be 1,500 V at operating temperature, to ensure the necessary safety according to VDE.

This leads to the consequence that the overall layer thickness of the insulating layer 14' merely can be designed half as thick or even smaller than with the embodiment according to FIG. 1.

While according to the embodiment of FIG. 1 an overall thickness of the insulating layer 14 of, about up to 500 $\mu$m is necessary, a respective reduction of the layer thickness 14' is reached when utilizing the grounded intermediate layer 26.

The intermediate layer 26 could theoretically also consist of metal which, however, would have again drawbacks due to the considerably higher coefficients of thermal expansion of metals.

Therefore, it is preferred to produce the intermediate layer 26 of an electrically conductive ceramic, such as of $TiO_2$ which during thermal spraying operation undergoes such a high oxygen loss, that it becomes electrically conductive. A further alternative for producing the intermediate layer 26 is the utilization of a cermet, such as of a nickel/chromium/cobalt alloy in which carbides, such as tungsten carbide particles and chromium carbide particles, are dispersed.

With such a cermet a particularly good conductivity can be reached, however, naturally the coefficient of thermal expansion is higher than that for instance $TiO_2$, however, still is smaller than that of common metallic layers.

Again the heat conductor layer 22, as mentioned before, is applied by thermal spraying in combination with a masking process to the lower side off the lowest partial layer 18' of the insulating layer 14'.

The individual layers 16, 18, 20 according to FIG. 1 or 26, 16', 18' according to FIG. 2 at their rims gradually verge toward the respective adjacent layer, so that gradual transitions result. This serves to counteract the risk of delamination in the rim region.

What is claimed is:

1. A ceramic cooktop comprising:

a cooking plate made of a material selected from the group formed by a glass ceramic and a glass;

a thermally sprayed ceramic bonding layer adhering to a selected surface of said cooking plate;

a thermally sprayed electrically conducting intermediate layer located on said bonding layer;

a thermally sprayed insulating layer located on said intermediate layer; and a thermally sprayed electric heat conductor layer located on said insulating layer;

wherein said insulating layer consists of a plurality of layers having porosities that diminish toward the heat conductor layer.

2. The ceramic cooktop of claim 1, wherein said electrically conducting intermediate layer is connected to ground.

3. The ceramic cooktop of claim 1, wherein said insulating layer consists of a material selected from the group formed by cordierite and mullite.

4. The ceramic cooktop of claim 1, wherein said layers each occupy an area diminishing toward the heat conductor layer.

5. A ceramic cooktop comprising:

a cooking plate made of a material selected from the group formed by a glass ceramic and a glass;

a thermally sprayed electric heat conductor layer;

a thermally sprayed insulating layer arranged between said cooking plate and said heat conductor layer; and an electrically conducting intermediate layer arranged between said cooking plate and said insulating layer;

wherein said insulating layer consists of a plurality of layers having porosities that diminish toward the heat conductor layer.

6. The ceramic cooktop of claim 5, wherein said electrically conducting intermediate layer is made of a cermet material having a metal matrix comprising at least one component selected from the group formed by nickel, cobalt and chromium.

7. The ceramic cooktop of claim 5, wherein said electrically conducting intermediate layer is made of a cermet material having a metal matrix being configured as an alloy comprising the major components nickel, cobalt and chromium.

8. The ceramic cooktop of claim 5, wherein said electrically conducting intermediate layer is made of a cermet material that further comprises carbide particles dispersed within said metal matrix.

9. The ceramic cooktop of claim 8, wherein said carbide particles are selected from the group formed by tungsten carbide and chromium carbide.

10. The ceramic cooktop of claim 5, further comprising a ceramic bonding layer located between said electrically conductive intermediate layer and said cooking plate.

11. The ceramic cooktop of claim 1, wherein said ceramic bonding layer is configured as a thermally sprayed material selected from the group formed by aluminum oxide, titanium oxide and mixtures thereof.

12. The ceramic cooktop of claim 5, wherein said insulating layer consists of a material selected from the group formed by cordierite and mullite.

13. The ceramic cooktop of claim 11, wherein said bonding layer is a thermally sprayed layer.

14. The ceramic cooktop of claim 11, wherein said layers each occupy an area diminishing toward the heat conductor layer.

15. A ceramic cooktop comprising:

a cooking plate made of a material selected from the group formed by a glass ceramic and a glass;

an electric heat conductor layer; and an insulating layer arranged between said cooking plate and said heat conductor layer;

wherein said insulating layer consists of a plurality of layers having porosities that diminish toward the heat conductor layer.

16. A ceramic cooktop comprising:

a cooking plate made of a material selected from the group formed by a glass ceramic and a glass;

a bonding layer arranged on a selected surface of said cooking plate;

an insulating layer arranged on said bonding layer; and an electric heat conductor layer;

wherein said insulating layer consists of a plurality of layers having porosities that diminish toward the heat conductor layer.

17. The ceramic cooktop of claim 15, further comprising an electrically conductive intermediate layer between said cooking plate and said insulating layer.

18. The ceramic cooktop of claim 17, wherein said electrically conductive intermediate layer is configured as an oxide layer that is rendered electrically conductive by oxygen loss during thermal spraying.

19. The ceramic cooktop of claim 17, wherein said intermediate layer consists of a cermet material having a metal matrix comprising at least one component selected from the group formed by nickel, cobalt and chromium.

20. The ceramic cooktop of claim 19, wherein said cermet material has a metal matrix being configured as an alloy comprising the major components nickel, cobalt and chromium.

21. The ceramic cooktop of claim 17, wherein said intermediate layer consists of a cermet material having a metal matrix comprising carbide particles dispersed within said metal matrix.

22. The ceramic cooktop of claim 21, wherein said carbide particles are selected from the group formed by tungsten carbide and chromium carbide.

23. The ceramic cooktop of claim 16, wherein said plurality of insulating layers consist of a material selected from the group formed by cordierite and mullite.

24. The ceramic cooktop of claim 23, wherein said plurality of insulating layers are thermally sprayed layers.

25. The ceramic cooktop of claim claim 16, wherein said layers each occupy an area diminishing toward said heat conductor layer.

26. The ceramic cooktop of claim 25, wherein said layers are centered with respect to each other.

27. The ceramic cooktop of claim 26, wherein said layers are arranged concentrically with respect to each other.

28. The ceramic cooktop of claim 16, wherein each of said layers comprises a rim section verging into a rim section of an adjacent layer.

29. The ceramic cooktop of claim 16, wherein each of said insulating layer consists of a material selected from the group formed by aluminum oxide, mullite, cordierite, aluminum oxide with additions of titanium oxide, zirconium oxide, mixtures of zirconium oxide and magnesium oxide.

30. A ceramic cooktop comprising:

a cooking plate made of a material selected from the group formed by a glass ceramic and a glass;

a bonding layer arranged on a selected surface of said cooking plate;

an electrically conductive intermediate layer arranged on said bonding layer;

an insulating layer arranged on said electrically conductive intermediate layer; and an electric heat conductor layer arranged on said insulating layer;

wherein said insulating layer consists of a plurality of layers having porosities that diminish toward the heat conductor layer.

31. The cooktop of claim 30, wherein said electrically conductive intermediate layer is grounded.

32. A method of producing a ceramic cooktop comprising the following steps:

providing a cooking plate made of a material selected from the group formed by a glass ceramic and a glass;

applying a first electrically insulating layer onto said intermediate layer;

applying a second electrically insulating layer onto said first electrically insulating layer; and applying an electric heat conductor layer onto said electrically insulating layer;

wherein said first and second electrically insulating layers are produced with different porosities, the porosity of said first insulating layer being larger than the porosity of said second insulating layer.

* * * * *